US011727744B2

(12) United States Patent
Ando et al.

(10) Patent No.: US 11,727,744 B2
(45) Date of Patent: Aug. 15, 2023

(54) PAPER SHEET STORAGE APPARATUS AND PAPER SHEET HANDLING APPARATUS

(71) Applicant: FUJITSU FRONTECH LIMITED, Tokyo (JP)

(72) Inventors: Atsushi Ando, Inagi (JP); Tomoyuki Tamahashi, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 17/382,633

(22) Filed: Jul. 22, 2021

(65) Prior Publication Data

US 2021/0350652 A1 Nov. 11, 2021

Related U.S. Application Data

(63) Continuation of application No. PCT/JP2019/010994, filed on Mar. 15, 2019.

(51) Int. Cl.
*G07D 11/12* (2019.01)
*G07D 11/22* (2019.01)

(52) U.S. Cl.
CPC ..... *G07D 11/22* (2019.01); *G07D 11/12* (2019.01)

(58) Field of Classification Search
CPC ..... G07D 11/22; G07D 11/12; B65H 43/08
(Continued)

(56) References Cited

U.S. PATENT DOCUMENTS

2010/0207319 A1* 8/2010 Sato ..... B65H 29/40 271/145
2016/0300209 A1* 10/2016 Schreckenberg .... H04B 5/0037
(Continued)

FOREIGN PATENT DOCUMENTS

JP 5753443 U 3/1982
JP 01112475 A 5/1989
(Continued)

OTHER PUBLICATIONS

JP2009023822A—Paper Sheet Treating Device, English machine translation, 7 pages (Year: 2022).*
(Continued)

*Primary Examiner* — Tuyen K Vo
(74) *Attorney, Agent, or Firm* — Greer Burns & Crain Ltd.

(57) ABSTRACT

A paper sheet storage apparatus (1) includes: a placement mount (10) on which bills (B), i.e., an example of paper sheets, are placed; a leading-edge position restriction guide (20) that restricts the position of the leading edge portion of a bill (B) in an entering direction (D) in which the bill (B) advances when being transported onto the placement mount (10); and a sensor (30) that detects the presence/absence of an accumulation space (S) for bills (B) that is located above the placement mount (10). The sensor (30) detects the presence/absence of an accumulation space (S) by using detection light (L) emitted to a space between a first position (P1) that is located on an opposite side of the leading-edge position restriction guide (20) from the bills (B) on the placement mount (10) and a second position (P2) below the first position (P1) that is located on an opposite side of the bills (B) on the placement mount (10) from the leading-edge position restriction guide (20).

2 Claims, 12 Drawing Sheets

(58) Field of Classification Search
USPC ..... 235/379
See application file for complete search history.

(56) References Cited

U.S. PATENT DOCUMENTS

| | | | | |
|---|---|---|---|---|
| 2017/0345244 | A1* | 11/2017 | Wada | B65H 1/14 |
| 2018/0033228 | A1* | 2/2018 | Akagi | B65B 5/00 |
| 2020/0346475 | A1* | 11/2020 | Ogawa | G05B 19/045 |

FOREIGN PATENT DOCUMENTS

| | | | | |
|---|---|---|---|---|
| JP | 2009023822 | A | * | 2/2009 |
| JP | 2009023822 | A | | 2/2009 |
| JP | 4877124 | B2 | | 2/2012 |
| JP | 2012064198 | A | | 3/2012 |
| JP | 2013025606 | A | | 2/2013 |

OTHER PUBLICATIONS

JPH01112475A—System for Managing Number Of Bank Notes In Safe Box, English machine translation, 2 pages (Year: 2022).*
ISR issued in PCT/JP2019/010994, dated May 28, 2019.
Written opinion of the ISR issued in PCT/JP2019/010994, dated May 28, 2019 (partial translation).
Office action issued in corresponding Japanese Patent Application No. 2021-506824, dated Sep. 21, 2021.
Office action issued in corresponding Japanese patent application No. 2021-506824, dated Apr. 5, 2022.
Office action issued in corresponding Chinese patent application No. 201980090466.6, dated Sep. 28, 2022.
EESR issued in European patent application No. EP 19 920 088.2, dated May 2, 2023.

* cited by examiner

PRIOR ART

PAPER SHEET STORAGE APPARATUS AND PAPER SHEET HANDLING APPARATUS

CROSS-REFERENCE TO RELATED APPLICATION

This application is continuation application of International Application PCT/JP2019/010994 filed on Mar. 15 2019 and designated the U.S., the entire contents of which are incorporated herein by reference.

FIELD OF THE INVENTION

The present invention relates to a paper sheet storage apparatus for storing paper sheets, and a paper sheet handling apparatus including the paper sheet storage apparatus.

BACKGROUND OF THE INVENTION

Paper sheet handling apparatuses such as automated teller machines (ATMs) have conventionally included paper sheet storage apparatuses for storing paper sheets such as bills, checks, or valuable paper. For example, the paper sheet storage apparatus maybe an attachable/detachable bill storage cassette. A paper sheet storage apparatus may include, for example, a bill storage cassette for each denomination.

Such paper sheet storage apparatuses may use a sensor that emits, to a space between a position above a placement mount on which bills are placed and a position below a transportation unit for transporting bills onto the placement mount, detection light for determining the presence/absence of an accumulation space in accordance with whether the detection light is blocked by bills (see, for example, Japanese Patent No. 4877124).

BRIEF SUMMARY OF THE INVENTION

In one aspect, a paper sheet storage apparatus includes: a placement mount on which paper sheets are placed; a leading-edge position restriction guide that restricts a position of a leading edge portion of a paper sheet in an entering direction in which the paper sheet advances when being transported onto the placement mount; and a sensor that detects presence/absence of an accumulation space for paper sheets that is located above the placement mount, wherein the sensor detects the presence/absence of the accumulation space by using detection light emitted to a space between a first position that is located on an opposite side of the leading-edge position restriction guide from the paper sheets on the placement mount and a second position below the first position that is located on an opposite side of the paper sheets on the placement mount from the leading-edge position restriction guide.

In another aspect, a paper sheet handling apparatus includes: a transportation path for transporting a paper sheet; and a paper sheet storage apparatus that stores the paper sheet transported on the transportation path, wherein the paper sheet storage apparatus includes: a placement mount on which paper sheets are placed; a leading-edge position restriction guide that restricts a position of a leading edge portion of a paper sheet in an entering direction in which the paper sheet advances when being transported onto the placement mount; and a sensor that detects presence/absence of an accumulation space for paper sheets that is located above the placement mount, wherein the sensor detects the presence/absence of the accumulation space by using detection light emitted to a space between a first position that is located on an opposite side of the leading-edge position restriction guide from the paper sheets on the placement mount and a second position below the first position that is located on an opposite side of the paper sheets on the placement mount from the leading-edge position restriction guide.

The object and advantages of the present invention will be realized by the elements set forth in the claims or combinations thereof.

DETAILED DESCRIPTION OF THE INVENTION

Figure 6:
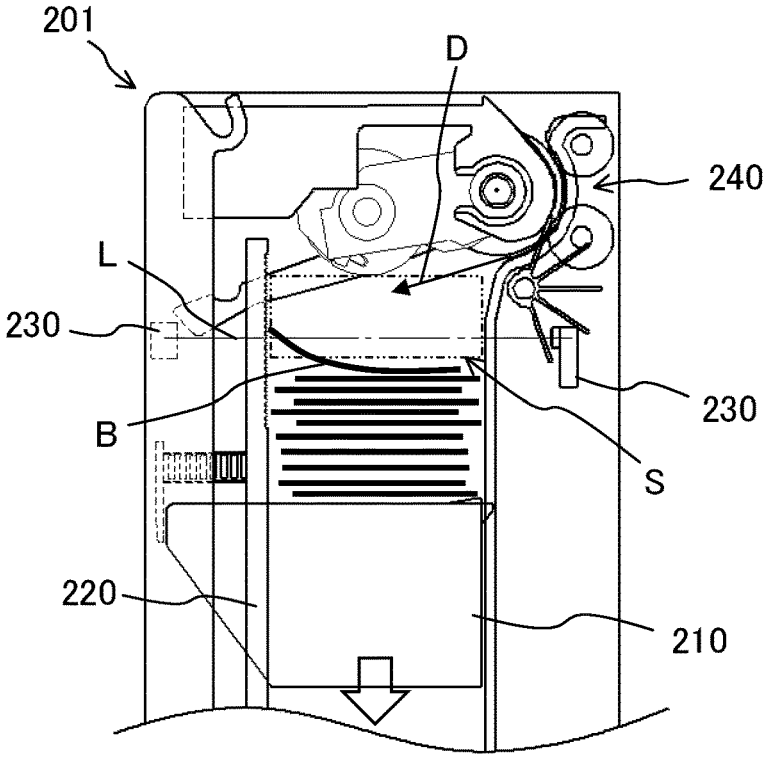
FIG. 6 is a left side view illustrating the internal structure of a paper sheet storage apparatus in accordance with a reference art.

FIG. 6 is a left side view illustrating the internal structure of a paper sheet storage apparatus 201 in accordance with a reference art.

The paper sheet storage apparatus 201 includes a placement mount 210, a leading-edge position restriction guide 220, a sensor 230, and a transportation unit 240.

The placement mount 210 can be lifted or lowered and has bills B placed thereon.

The leading-edge position restriction guide 220 restricts the position of the leading edge portion of a bill B in an entering direction D in which the bill B advances when being transported onto the placement mount 210.

The sensor 230 detects the presence/absence of an accumulation space S (indicated by a two-dot dash line) for bills B that is located above the placement mount 210. For example, the sensor 230 may include an emission unit for horizontally emitting detection light L and a light reception unit for receiving the detection light L.

The transportation unit 240 includes a plurality of rollers and an impeller and transports a bill B in the entering direction D onto the placement mount 210.

In the paper sheet storage apparatus 201, if a bill B leans, as depicted in FIG. 6, against the leading-edge position restriction guide 220, the horizontal detection light L will be blocked by the bill B, like when there are several tens to hundreds of bills B, despite the presence of the sufficient accumulation space S. Thus, the sensor 230 will detect that a sufficient accumulation space S is not present. Likewise, if a bill B is folded upward, the sensor 230 could detect that a sufficient accumulation space S is not present, despite the presence of the sufficient accumulation space S.

In the case of a sensor that, as described above, emits detection light to a space between a position above a placement mount on which bills are placed and a position below a transportation unit for transporting a bill onto the placement mount, if a plurality of bills lean against the leading-edge position restriction guide 220 depicted in FIG. 6, such a sensor would not be capable of detecting that there is no accumulation space on the leading-edge side of the bills. Thus, a fault such as jamming of a bill could occur.

The following describes a paper sheet storage apparatus and a paper sheet handling apparatus in accordance with embodiments by referring to the drawings.

Figure 1:
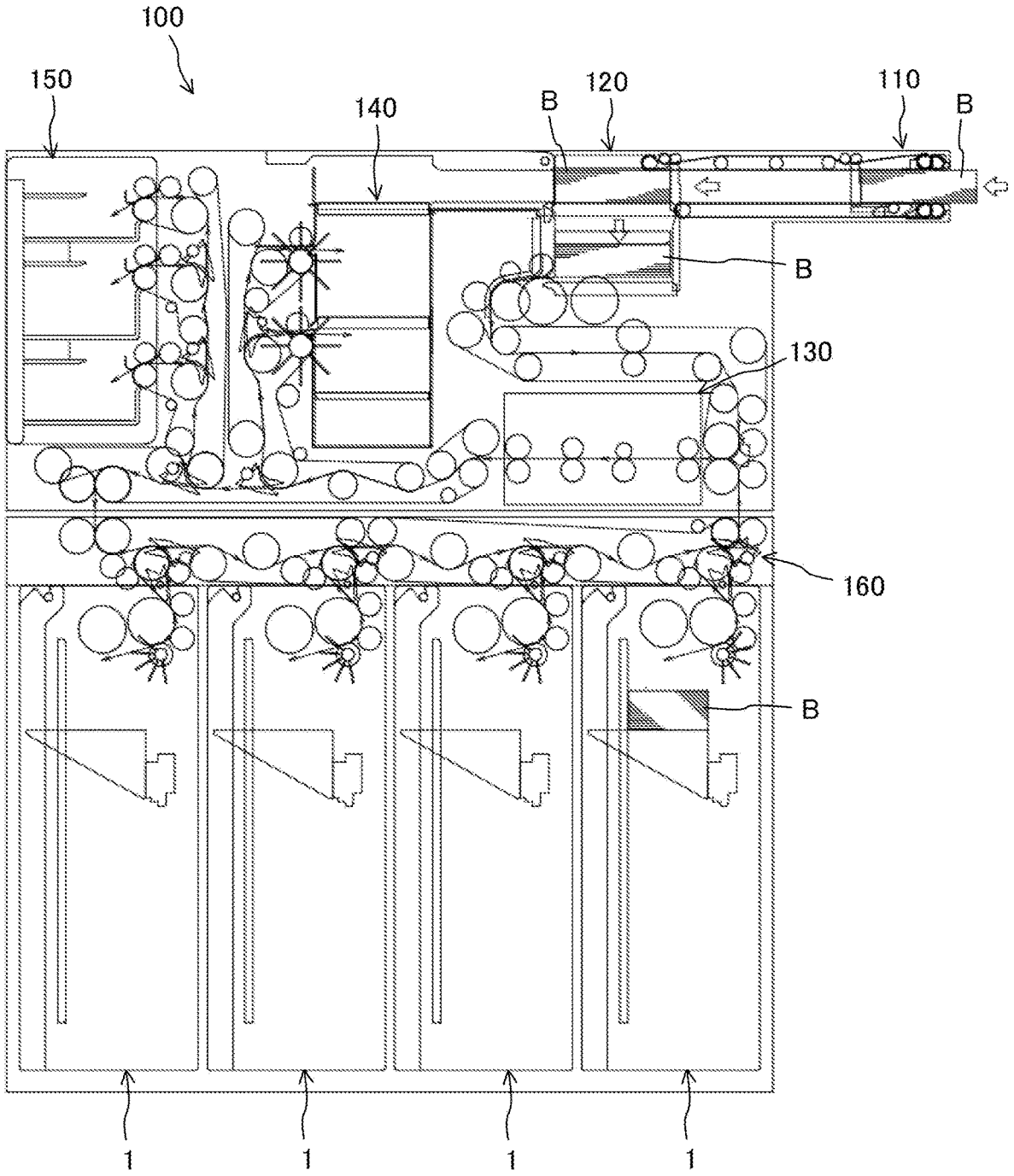
FIG. 1 is a left side view illustrating the internal structure of a paper sheet handling apparatus in accordance with embodiments.

FIG. 1 is a left side view illustrating the internal structure of a paper sheet handling apparatus 100 in accordance with embodiments.

As depicted in FIG. 1, the paper sheet handling apparatus 100 includes a plurality of paper sheet storage apparatuses 1, a money reception-ejection unit 110, a separation unit 120, a validation unit 130, a temporary retention unit 140, a reject unit 150, and a transportation path 160. For example, the paper sheet handling apparatus 100 may be an automated teller machine (ATM).

The money reception-ejection unit 110 receives or ejects a bill B, i.e., an example of a paper sheet. The paper sheet may be another type of paper sheet such as a check or valuable paper.

The separation unit 120 lifts bills B to an upper position at which a bill B is received from the money reception-ejection unit 110 or lowers bills B to a lower position at which a bill B is drawn out toward the validation unit 130. The separation unit 120 temporarily stores a bill B received by the money reception-ejection unit 110.

The validation unit 130 performs validation of a bill B transported from the separation unit 120. For example, the validation unit 130 may determine whether the bill B is normal on the basis of the authenticity, thickness, length, or deterioration thereof.

The temporary retention unit 140 temporarily stores a bill B that has undergone validation performed by the validation unit 130.

The reject unit 150 stores bills B not to be returned to customers, among bills B determined to be abnormal by the validation unit 130.

The transportation path 160 is a transportation path for transporting bills B between the plurality of paper sheet storage apparatuses 1, the money reception-ejection unit 110, the separation unit 120, the validation unit 130, the temporary retention unit 140, and the reject unit 150. Transportation members such as transportation rollers for transporting bills B are disposed on the transportation path 160.

Figure 2:
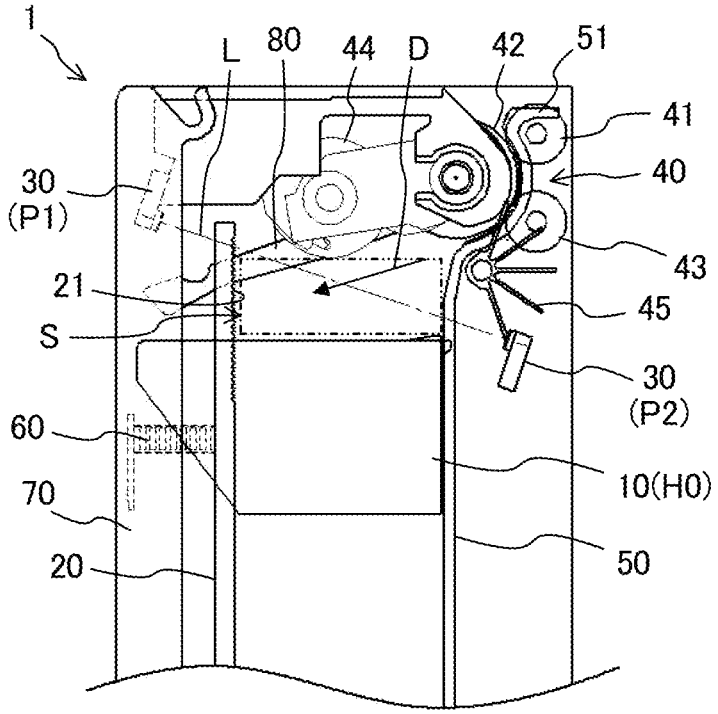
FIG. 2 is a left side view illustrating the internal structure of a paper sheet storage apparatus in accordance with embodiments.

FIG. 2 is a left side view illustrating the internal structure of the paper sheet storage apparatus 1.

Figure 3:
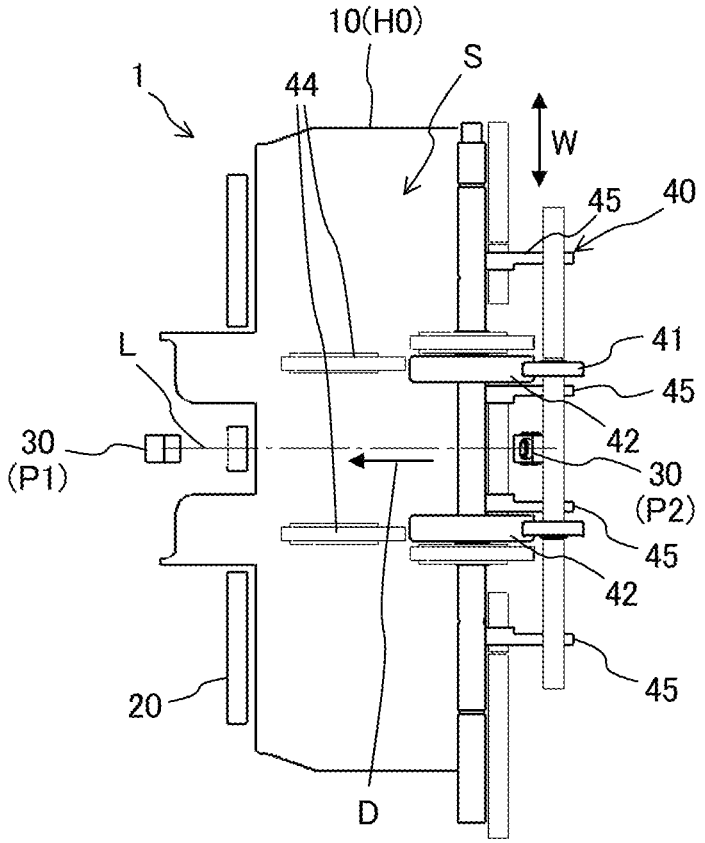
FIG. 3 is a plan view illustrating the internal structure of a paper sheet storage apparatus in accordance with embodiments.

FIG. 3 is a plan view illustrating the internal structure of the paper sheet storage apparatus 1.

As depicted in FIG. 2, the paper sheet storage apparatus 1 includes a placement mount 10, a leading-edge position restriction guide 20, a sensor 30, a transportation unit 40, a rear-edge position restriction guide 50, a spacer 60, an open-close gate 70, and a pressing part 80. Note that indications of the rear-edge position restriction guide 50, the spacer 60, the open-close gate 70, and the pressing part 80 are omitted in FIG. 3.

For example, the paper sheet storage apparatus 1 may be a bill storage cassette that can be attached to and detached from the paper sheet handling apparatus 100 depicted in FIG. 1. The paper sheet storage apparatus 1 may be integral with, i.e., incapable of being detached from, the paper sheet handling apparatus 100.

Figure 4A:
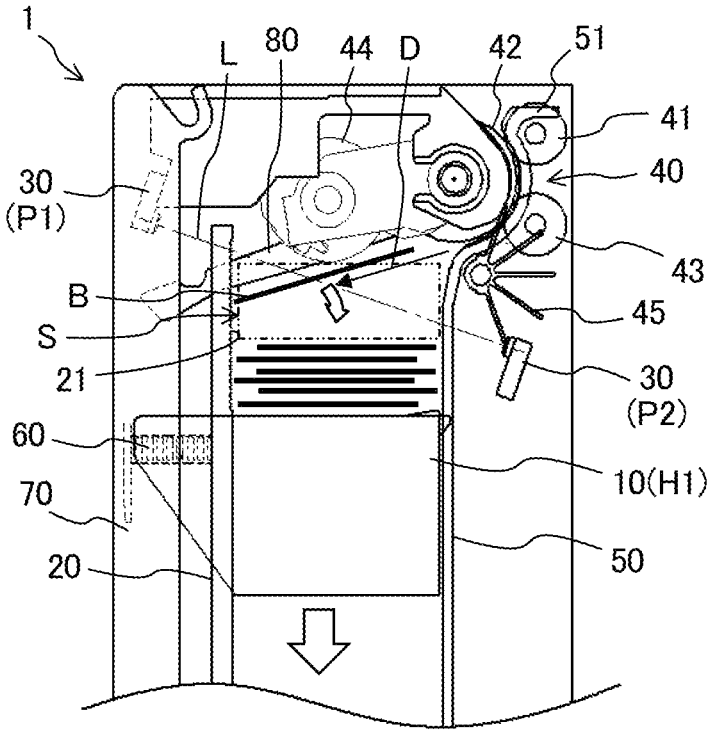
FIG. 4A is an explanatory diagram for the detecting of the presence/absence of an accumulation space in a paper sheet storage apparatus in accordance with embodiments (example 1)
Figure 4B:
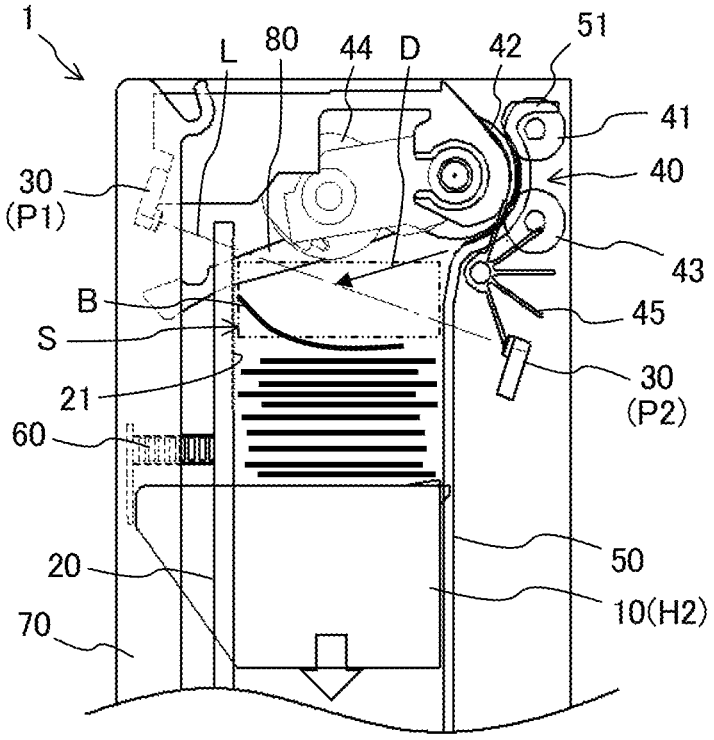
FIG. 4B is an explanatory diagram for the detecting of the presence/absence of an accumulation space in a paper sheet storage apparatus in accordance with embodiments (example 2)
Figure 4C:
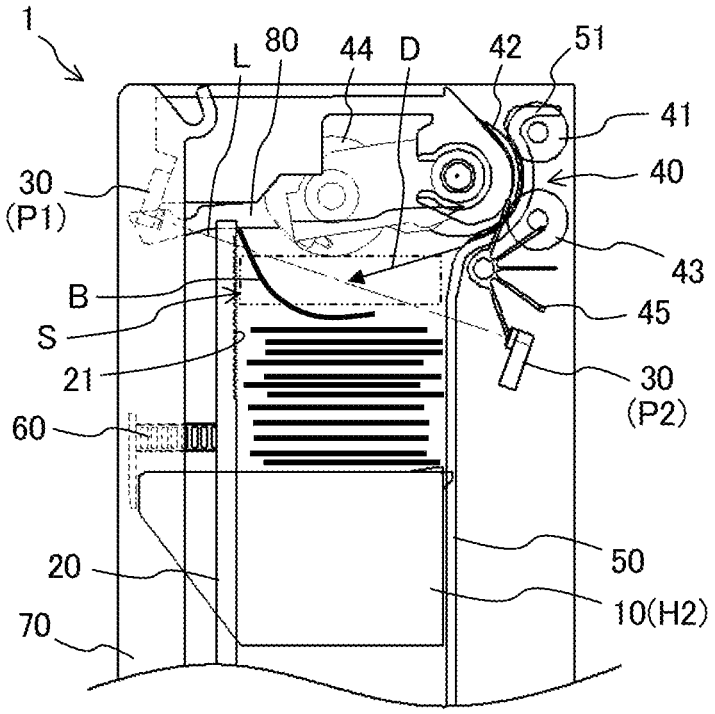
FIG. 4C is an explanatory diagram for the detecting of the presence/absence of an accumulation space in a paper sheet storage apparatus in accordance with embodiments (example 3)

For example, the placement mount 10 can be lifted or lowered to a height H0 indicated in FIGS. 2 and 3, a height H1 indicated in FIG. 4A less than the height H0, or a height H2 indicated in FIGS. 4B and 4C less than the height H1. Bills B may be placed on the placement mount 10.

The leading-edge position restriction guide 20 is located on the downstream side in an entering direction D in which a bill B advances when being transported onto the placement mount 10 (located on the left side in FIG. 2), and restricts the position of the leading edge portion of the bill B. An uneven surface 21 is formed on a surface of the leading-edge position restriction guide 20 that contacts (a) bill(s) B. The uneven surface 21 is provided to prevent a bill B transported by the transportation unit 40 from entering the space between the leading-edge position restriction guide 20 and a plurality of bills B on the placement mount 10 depicted in FIG. 4A. For example, the uneven surface 21 may be a jagged surface.

The sensor 30 detects the presence/absence of an accumulation space S (indicated by a two-dot dash line) for bills B that is located above the placement mount 10. The sensor 30 detects the presence/absence of an accumulation space S by using detection light L emitted to a space between a first position P1 that is located on an opposite side of the leading-edge position restriction guide 20 from the bills B on the placement mount 10 (located on the left side in FIG. 2) and a second position P2 below the first position P1 that is located on an opposite side of the bills B on the placement mount 10 from the leading-edge position restriction guide 20 (located on the right side in FIG. 2). For example, the sensor 30 may include an emission unit that is disposed at either of the first position P1 and the second position P2 and emits detection light L, and a light reception unit that is disposed at the other of the first position P1 and the second position P2 and receives the detection light L. The first position P1 may be located above the upper edge of the accumulation space S (e.g., above the lower edge of the transportation roller 44). Detection light L may be emitted to travel above the accumulation space S from the leading-edge side of bills B on the placement mount 10. The orientation of detection light L (sensor 30) is set such that the accumulation space S ensures a sufficient space for preventing a bill B from causing a jam.

The transportation unit 40 includes transportation rollers 41-44 and impellers 45. As depicted in FIG. 3, two transportation rollers 41, two transportation rollers 42, two transportation rollers 43, and two transportation rollers 44 are arranged in the width direction W of a bill B that is orthogonal to the entering direction D. Four impellers 45 are arranged in the width direction W of a bill B.

In the process of the paper sheet storage apparatus 1 storing a bill B received by the paper sheet handling apparatus 100, the transportation unit 40 transports the bill B, which is transported from the transportation path 160 depicted in FIG. 1, onto the placement mount 10. In the process of the paper sheet storage apparatus 1 drawing out a bill B upon money ejection of the paper sheet handling apparatus 100, the transportation unit 40 transports the bill B from the placement mount 10 to the transportation path 160.

The transportation roller 41 is a driven roller disposed to face the transportation roller 42, which is a driving roller. The transportation roller 41 rotates in accordance with a rotation of the transportation roller 42.

The transportation roller 42 is a driving roller that rotates through a driving operation using the same driving source as the transportation roller 44. A transmission belt (not illustrated) covers the central shaft of the transportation roller 42 and the central shaft of the transportation roller 44. As depicted in FIG. 3, the two transportation rollers 42 each include two rollers adjacent to each other in the width direction W of bills B that is orthogonal to the entering direction D of the bills B. For example, the rollers on the outsides in the width direction W may serve to separate a bill B when the bill B is being drawn out.

The transportation roller 43 is disposed below the transportation roller 41. As with the transportation roller 41, the transportation roller 43 is a driven roller that is disposed to face the transportation roller 42 and rotates in accordance with a rotation of the transportation roller 42.

The transportation roller 44 is a driving roller that rotates through a driving operation using the same driving source as the transportation roller 42. The transportation roller 44 is disposed to be swingable with respect to the central shaft of the transportation roller 42 and biased downward by a biasing member (not illustrated). In the process of the paper sheet storage apparatus 1 drawing out a bill B, the transportation roller 44 draws out the bill B while being lifted by being pressed upward by the bill B against the biasing force of the biasing member.

The impeller 45 is disposed below the transportation roller 42. The impeller 45 slaps, by using a plurality of blades, downward the rear edge portion of a bill B transported from between the transportation rollers 42 and 43 toward the placement mount 10, so as to prevent collision of the following bill.

The rear-edge position restriction guide 50 is disposed to face the leading-edge position restriction guide 20 and restricts the position of the rear edge portion of a bill B. The rear-edge position restriction guide 50 includes a transportation guide section 51. The transportation guide section 51 extends upward to guide a bill B transported by the transportation unit 40. The transportation guide section 51 is provided with a through hole or a notch (not illustrated) for preventing interference with the transportation rollers 41 and 43.

The spacer 60 is disposed between the open-close gate 70 and the leading-edge position restriction guide 20 and defines a position for the leading-edge position restriction guide 20 in accordance with the size of bills B.

The open-close gate 70 closes the paper sheet storage apparatus 1 in an openable manner.

For example, the pressing part 80 may be disposed to be swingable with respect to the central shaft of the transportation roller 42 and lowered under the weight thereof to the position indicated in FIG. 2. When the placement mount 10 is lifted, the pressing part 80 is pressed upward by the bills B on the placement mount 10. When a bill B is being transported by the transportation unit 40 onto the placement mount 10, the pressing part 80 may also function as a guide for preventing the bill B from entering the space upward of the leading-edge position restriction guide 20. The pressing part 80 is disposed at a position in the width direction W of bills B at which the pressing part 80 does not interfere with detection light L, or includes a through hole through which detection light L passes.

FIGS. 4A-4C are explanatory diagrams for the detecting of the presence/absence of an accumulation space S in the paper sheet storage apparatus 1 in accordance with embodiments.

As indicated in FIG. 4A, a bill B is transported by the transportation unit 40 in the entering direction D onto the placement mount 10, comes into contact with the uneven surface 21 of the leading-edge position restriction guide 20, and is placed on the placement mount 10.

If a bill B on the placement mount 10 slightly leans, as depicted in FIG. 4B, against the leading-edge position restriction guide 20 or if a bill B placed on the placement mount 10 is folded upward (this situation is not illustrated), detection light L will not be blocked by the bill B, so the sensor 30 detects that there is a sufficient accumulation space S, unlike the sensor 230 of the paper sheet storage apparatus 201 in accordance with the reference art depicted in FIG. 6.

By contrast, if, as depicted in FIG. 4C, a bill B leaning against the leading-edge position restriction guide 20 lifts the pressing part 80 and the leading edge portion of the bill B reaches a position above the lower edge of the transportation roller 44, i.e., above the position of the upper edge of an accumulation space S, the sensor 30 detects that a sufficient accumulation space S is not present. Thus, the transportation unit 40 and the transportation path 160 depicted in FIG. 1 stop transportation of bills B onto the placement mount 10. Accordingly, owing to the bill B lifting the pressing part 80, the following bill B is not placed onto the placement mount 10, thereby preventing a jam from occurring within the transportation unit 40.

FIGS. 5A-5F are explanatory diagrams for processing performed by the paper sheet handling apparatus 100 in accordance with embodiments.

Figure 5A:
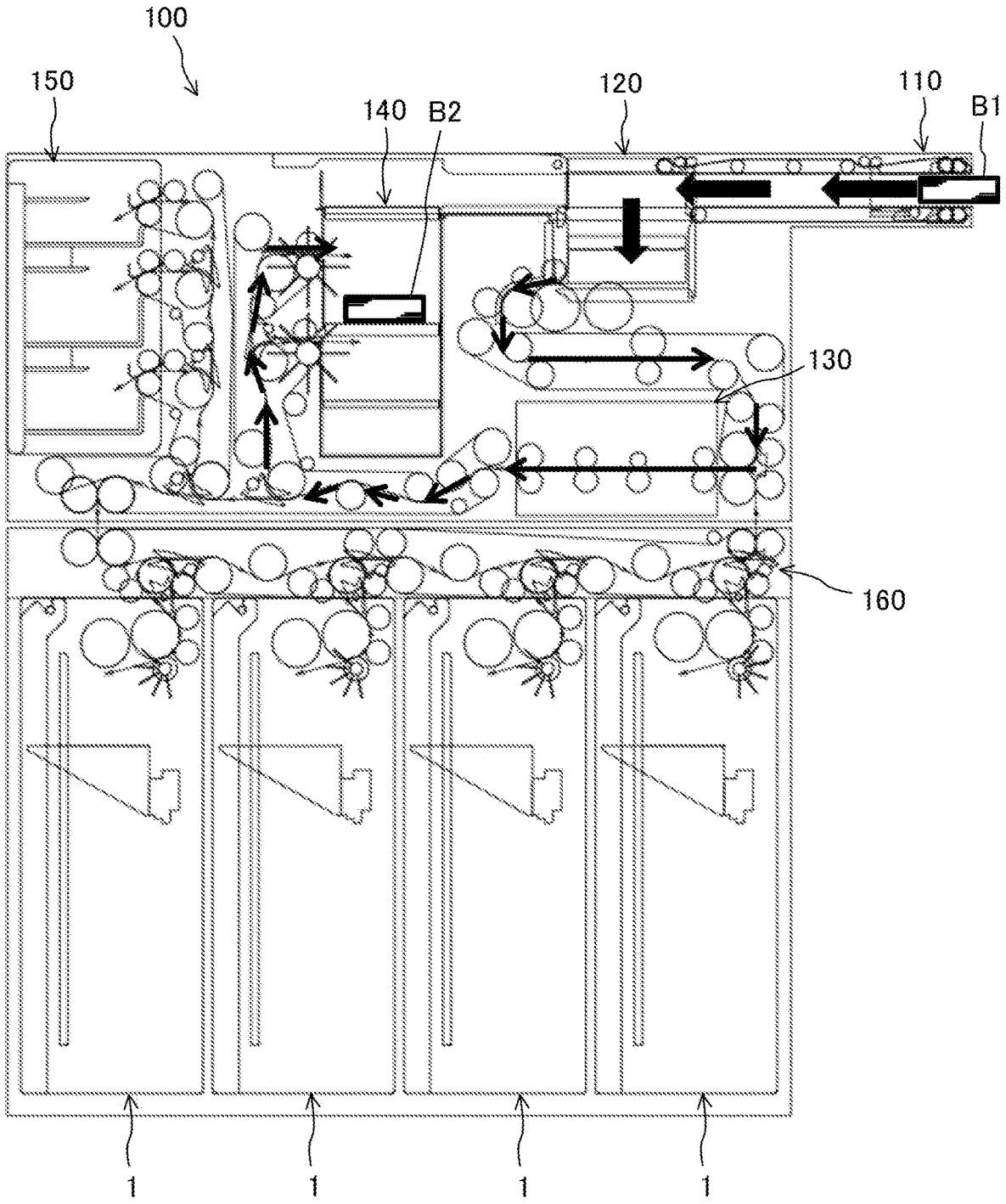
FIG. 5A is an explanatory diagram for processing performed by a paper sheet handling apparatus in accordance with embodiments (example 1)

A plurality of bills B1 inserted into the money reception-ejection unit 110 by, for example, a customer are, as indicated in FIG. 5A, temporarily stored in the separation unit 120, then lowered within the separation unit 120, and transported one by one to the validation unit 130. The number of bills B1 may be counted when the bills B1 are being transported one by one from the separation unit 120. Then, bills B1 undergo validation performed by the validation unit 130 and are transported to the temporary retention unit 140 (bills B2).

Figure 5B:
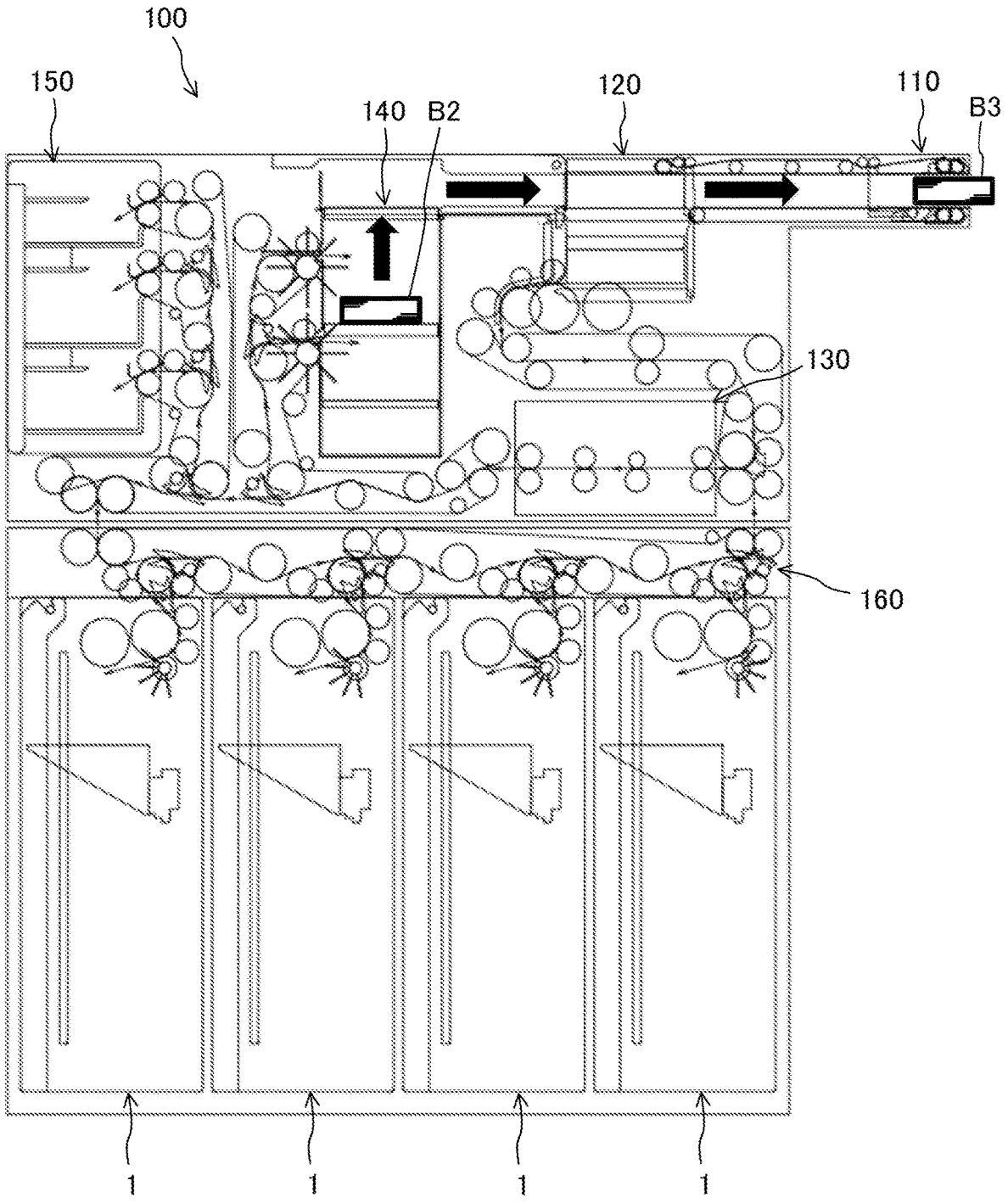
FIG. 5B is an explanatory diagram for processing performed by a paper sheet handling apparatus in accordance with embodiments (example 2)

If a bill B2 transported to the temporary retention unit 140 has been determined to be abnormal by the validation unit 130 and thus should be returned, the bill B2 will be, as indicated in FIG. 5B, transported to the money reception-ejection unit 110 (bill B3).

Figure 5C:
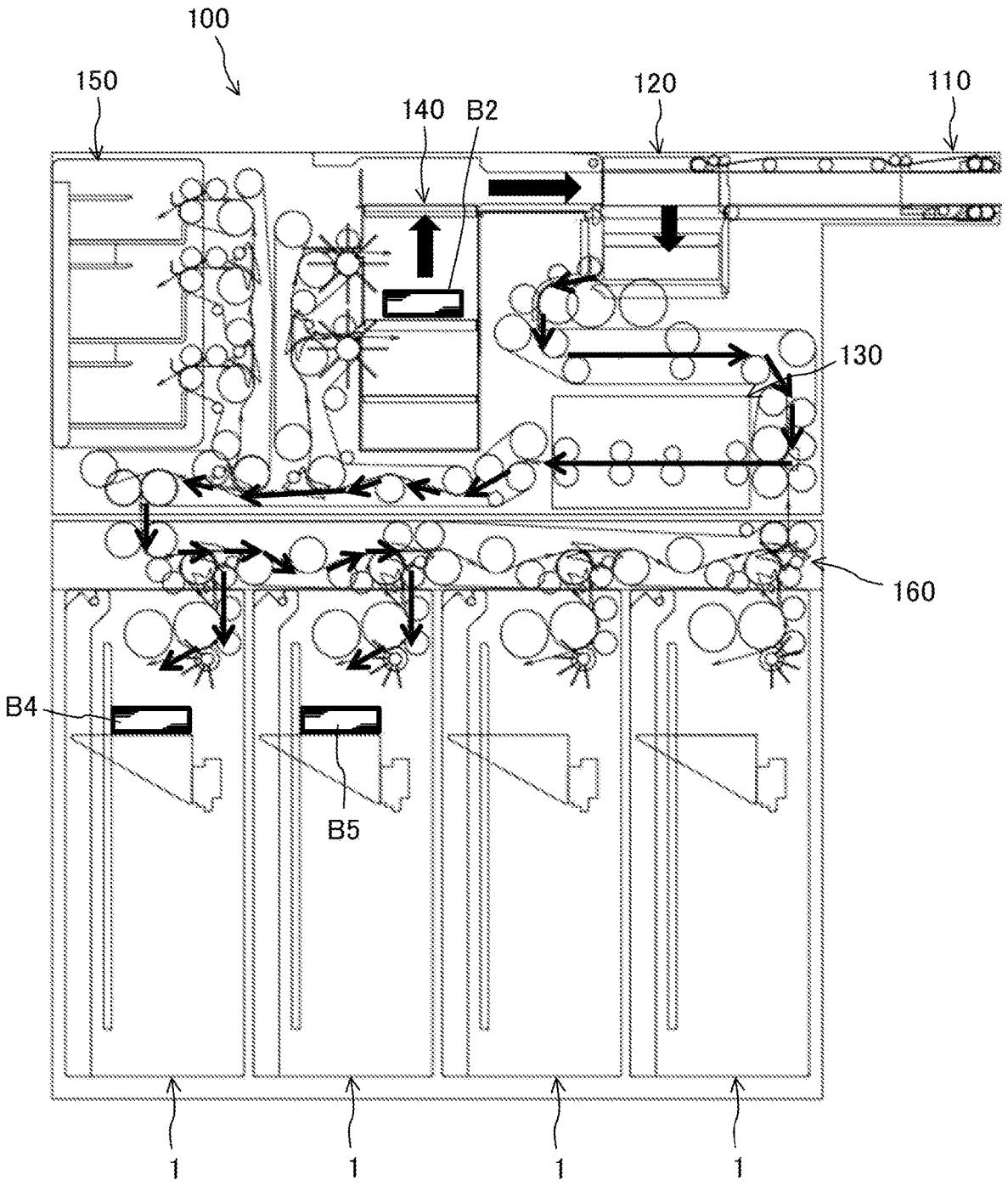
FIG. 5C is an explanatory diagram for processing performed by a paper sheet handling apparatus in accordance with embodiments (example 3)

When bills B2 transported to the temporary retention unit 140 have been determined to be normal by the validation unit 130, the bills B2 will, as indicated in FIG. 5C, be transported to the separation unit 120 again, pass the validation unit 130, and be transported to paper sheet storage apparatuses 1 for, for example, corresponding denominations (bills B4 and B5). A bill determined to be abnormal by the validation unit 130 is transported to the reject unit 150.

Figure 5D:
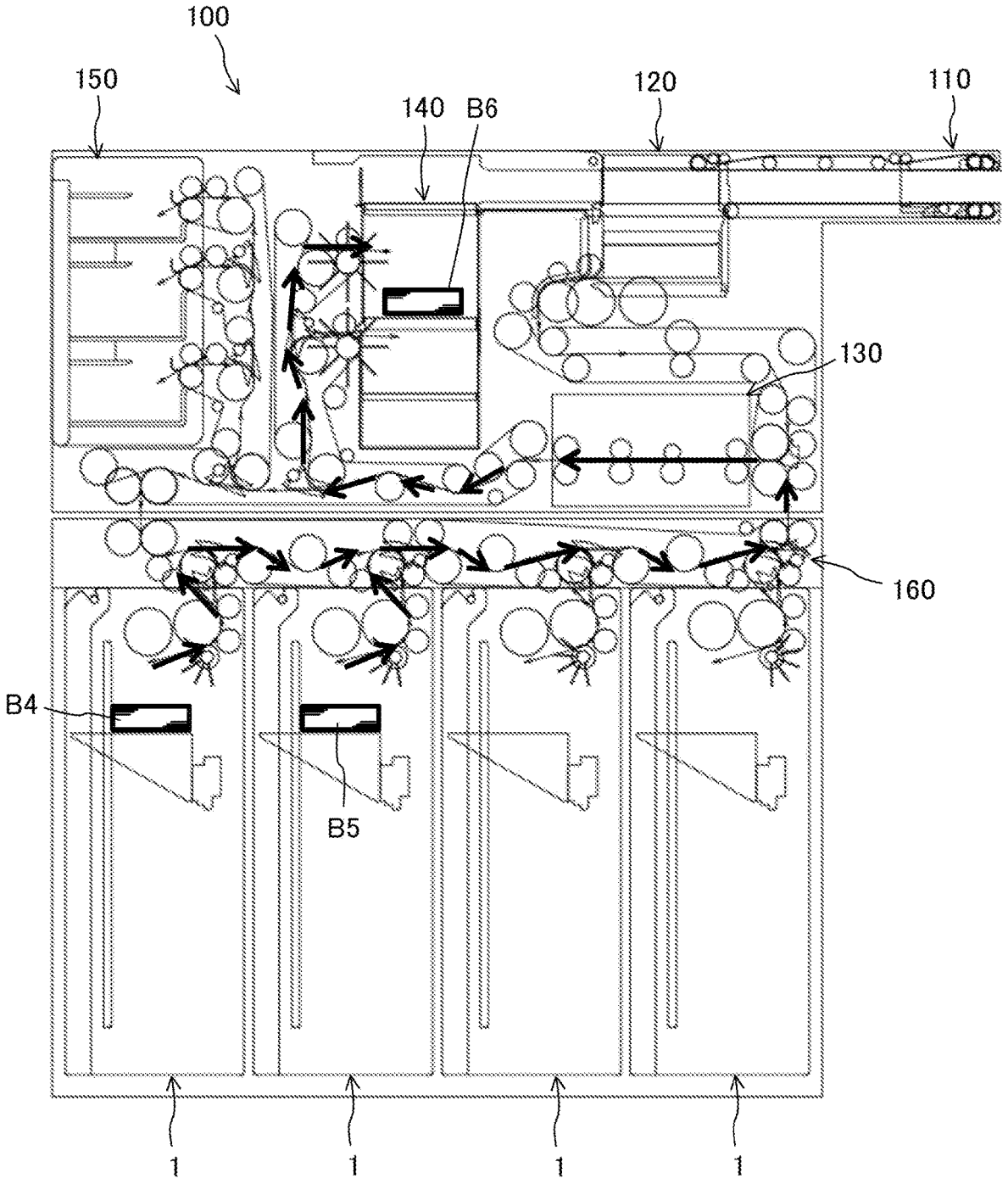
FIG. 5D is an explanatory diagram for processing performed by a paper sheet handling apparatus in accordance with embodiments (example 4)

In the ejecting of bills B, bills B4 and B5 drawn out of paper sheet storage apparatuses 1 pass the validation unit 130 and are transported to the temporary retention unit 140 (bills B6), as indicated in FIG. 5D. A bill determined to be abnormal by the validation unit 130 is transported to the reject unit 150.

Figure 5E:
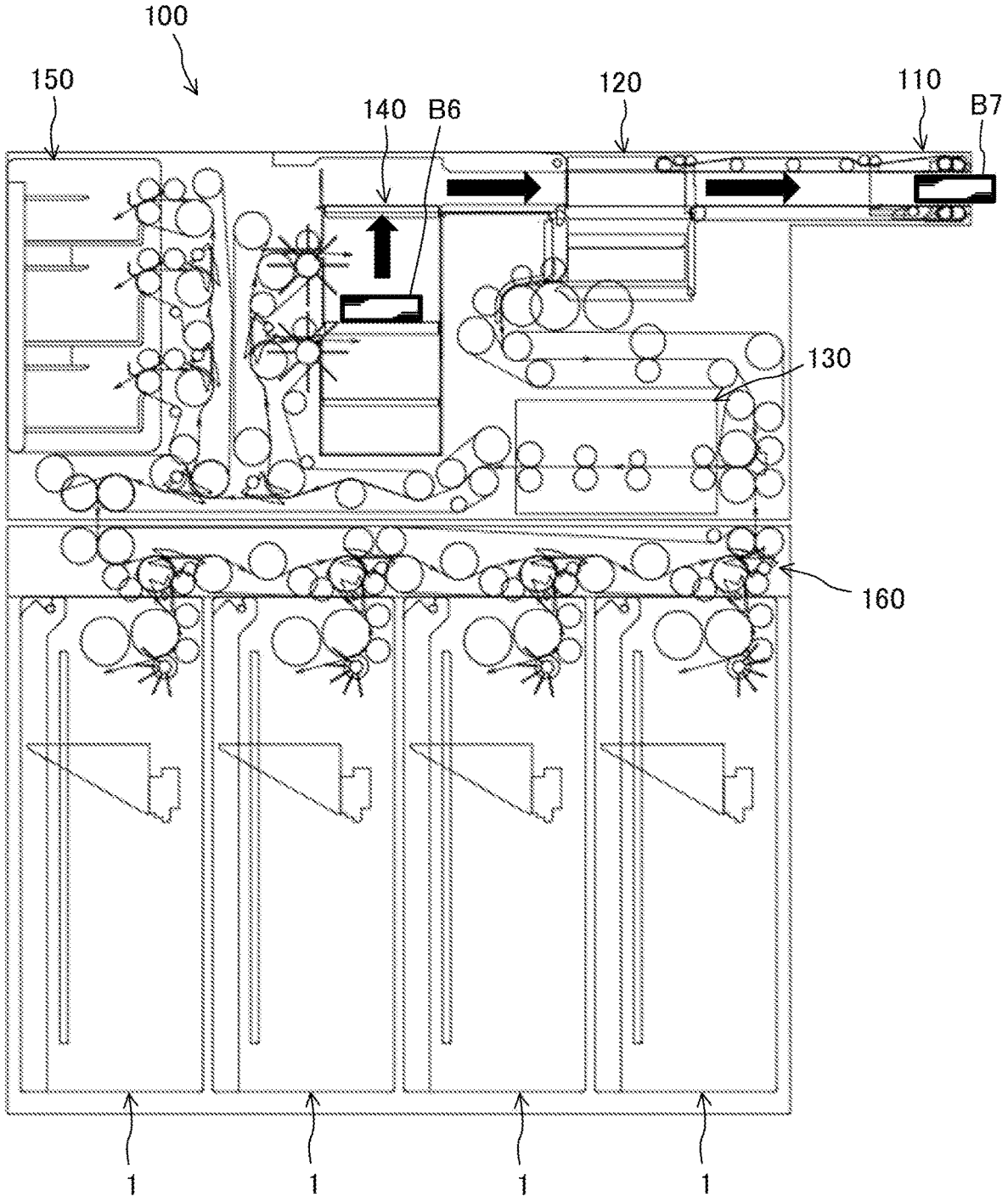
FIG. 5E is an explanatory diagram for processing performed by a paper sheet handling apparatus in accordance with embodiments (example 5)

As indicated in FIG. 5E, a bill B6 transported to the temporary retention unit 140 is transported to the money reception-ejection unit 110 (bill B7) and ejected.

In the embodiments described so far, the paper sheet storage apparatus 1 includes: the placement mount 10 on which a bill B, i.e., an example of the paper sheet, is placed; the leading-edge position restriction guide 20 that restricts the position of the leading edge portion of a bill B in the entering direction D in which the bill B advances when being transported onto the placement mount 10; and the sensor 30 that detects the presence/absence of an accumulation space S for bills B that is located above the placement mount 10. The sensor 30 detects the presence/absence of an accumulation space S by using detection light L emitted to a space between a first position P1 that is located on an opposite side of the leading-edge position restriction guide 20 from the bills B on the placement mount 10 and a second position P2 below the first position P1 that is located on an opposite side of the bills B on the placement mount 10 from the leading-edge position restriction guide 20.

As described above, detection light L is emitted to the space between the first position P1 that is located on an opposite side of the leading-edge position restriction guide 20 from the bills B on the placement mount 10 and the second position P2 located obliquely downward of the first position P1. Accordingly, if a bill B on the placement mount 10 slightly leans, as depicted in FIG. 4B, against the leading-edge position restriction guide 20 and a sufficient accumulation space S is present, it is possible to suppress an erroneous detection that a sufficient accumulation space S is not present, unlike in the case of the sensor 230 of the paper sheet storage apparatus 201 in accordance with the reference art depicted in FIG. 6 that horizontally emits detection light L. Moreover, the first position P1 for the sensor 30 is located on the opposite side of the leading-edge position restriction guide 20 from the bills B on the placement mount 10, so in comparison to when the first position P1 is located above the placement mount 10, it can be detected that a sufficient accumulation space S is not present on the leading-edge side of bills B due to, for example, a bill B leaning against the leading-edge position restriction guide 20, thereby suppressing a fault such as a jam from occurring.

Accordingly, embodiments allow the accuracy in detecting the presence/absence of an accumulation space S for bills B to be enhanced.

In embodiments, the first position P1 is located above the accumulation space S. Accordingly, if a bill B on the placement mount 10 slightly leans, as depicted in FIG. 4B, against the leading-edge position restriction guide 20 and a sufficient accumulation space S is present, it is possible to more reliably suppress an erroneous detection that a sufficient accumulation space S is not present.

In embodiments, detection light L is emitted to travel above the accumulation space S from the leading-edge side of bills B on the placement mount 10. In this way, it can be more reliably detected that a sufficient space S is not present on the leading-edge side of bills B due to, for example, a bill B leaning against the leading-edge position restriction guide 20.

The present invention is not simply limited to the embodiments described herein. Components of the embodiments may be embodied in a varied manner in an implementation phase without departing from the gist of the invention. A plurality of components disclosed with reference to the described embodiments maybe combined, as appropriate, to achieve various inventions. For example, all of the components indicated with reference to embodiments may be combined as appropriate. Accordingly, various variations and applications can be provided, as a matter of course, without departing from the gist of the invention.

The invention claimed is:

1. A paper sheet storage apparatus comprising:

a placement mount on which paper sheets are placed;

a leading-edge position restriction guide that restricts a position of a leading edge portion of a paper sheet in an entering direction in which the paper sheet advances when being transported onto the placement mount;

a sensor that detects presence/absence of an accumulation space for paper sheets that is located above the placement mount;

a transportation roller that draws out the paper accumulated in the accumulation space; and a pressing part that prevents the paper sheets from entering the space upward of the leading-edge position restriction guide, wherein the sensor detects the presence/absence of the accumulation space by using detection light emitted to a space between a first position that is located on an opposite side of the leading-edge position restriction guide from the paper sheets on the placement mount and a second position below the first position that is located on an opposite side of the paper sheets on the placement mount from the leading-edge position restriction guide, an upper edge of the accumulation space is a lower edge is a lower edge of the transportation roller, the first position is located above the accumulation space, the detection light is emitted to travel above the accumulation space from a leading edge side of the paper sheets on the placement mount, and the sensor detects that the paper leaning against the leading-edge position restriction guide lifts the pressing part and the leading-edge portion of the paper reaches a position above the upper edge of the accumulation space.

2. A paper sheet handling apparatus comprising:

a transportation path for transporting a paper sheet; and a paper sheet storage apparatus that stores the paper sheet transported on the transportation path, wherein the paper sheet storage apparatus includes a placement mount on which paper sheets are placed, a leading-edge position restriction guide that restricts a position of a leading edge portion of a paper sheet in an entering direction in which the paper sheet advances when being transported onto the placement mount, a sensor that detects presence/absence of an accumulation space for paper sheets that is located above the placement mount, a transportation roller that draws out the paper accumulated in the accumulation space; and a pressing part that prevents the paper sheets from entering the space upward of the leading-edge position restriction guide, wherein the sensor detects the presence/absence of the accumulation space by using detection light emitted to a space between a first position that is located on an opposite side of the leading-edge position restriction guide from the paper sheets on the placement mount and a second position below the first position that is located on an opposite side of the paper sheets on the placement mount from the leading-edge position restriction guide, an upper edge of the accumulation space is a lower edge of the transportation roller, the first position is located above the accumulation space, the detection light is emitted to travel above the accumulation space from a leading-edge side of the paper sheets on the placement mount, and the sensor detects that the paper leaning against the leading-edge position restriction guide lifts the pressing part and the leading-edge portion of the paper reaches a position above the upper edge of the accumulation space.

* * * * *